United States Patent [19]

Achia

[11] 4,377,467

[45] Mar. 22, 1983

[54] SOLVENT DEWAXING WAXY HYDROCARBON OILS USING DEWAXING AID

[75] Inventor: Biddanda U. Achia, Sarnia, Canada

[73] Assignee: Exxon Research and Engineering Co., Florham Park, N.J.

[21] Appl. No.: 229,664

[22] Filed: Jan. 30, 1981

[51] Int. Cl.[3] ..... C10G 73/06; C10G 73/08

[52] U.S. Cl. ..... 208/33; 208/35; 208/38

[58] Field of Search ..... 208/33, 35, 38; 252/42; 44/62, 66

[56] References Cited

U.S. PATENT DOCUMENTS

| | | | |
|---|---|---|---|
| 1,993,396 | 3/1935 | Bennett | 196/19 |
| 2,008,674 | 7/1935 | Berne-Allen | 196/19 |
| 2,132,354 | 10/1938 | Knowles et al. | 196/18 |
| 2,155,645 | 4/1939 | Evans et al. | 196/18 |
| 2,158,358 | 5/1939 | Evans | 196/18 |
| 2,178,328 | 10/1939 | Story | 196/19 |
| 2,181,638 | 11/1939 | Cook | 196/19 |
| 2,260,994 | 10/1941 | Knowles | 196/18 |
| 2,698,279 | 12/1954 | Mondria | 196/18 |
| 2,791,539 | 5/1957 | Mondria et al. | 196/18 |
| 3,458,430 | 7/1969 | Henselman et al. | 208/33 |

*Primary Examiner*—Winston A. Douglas
*Assistant Examiner*—William Leader
*Attorney, Agent, or Firm*—Joseph J. Allocca

[57] ABSTRACT

An improved dewaxing aid for solvent dewaxing processes comprising a mixture of (a) lithium isostearate and (b) a polymer of an ester of at least one aliphatic alcohol with methacrylic acid or acrylic acid having an average molecular weight ranging from between about 300,000 to 2,000,000. The lithium isostearate, when combined with the acrylic polymer, synergistically improves the efficiency of wax separation. This has been found to be especially useful for dewaxing heavy petroleum oil fractions, such as bright stocks.

12 Claims, No Drawings

SOLVENT DEWAXING WAXY HYDROCARBON OILS USING DEWAXING AID

BACKGROUND OF THE INVENTION

1. Field of the Invention

This invention relates to a dewaxing aid useful in solvent dewaxing processes. More particularly, this invention relates to an improved dewaxing aid useful in solvent dewaxing processes wherein the improvement comprises a dewaxing aid comprising a mixture of (a) lithium isostearate and (b) an acrylic ester polymer. Still more particularly this invention relates to an improved dewaxing aid for solvent dewaxing processes wherein the dewaxing aid comprises a mixture of (a) lithium isostearate and (b) a polymer of an ester of at least one aliphatic alcohol with methacrylic acid or acrylic acid having an average molecular weight ranging between about 300,000 to 2,000,000.

2. Description of the Prior Art

Waxes in wax-containing hydrocarbon oils are removed therefrom by chilling the oil to precipitate out the wax and then separating the solid wax particles from the dewaxed oil by filtration or centrifugation. Industrial dewaxing processes include press dewaxing processes wherein the wax-containing oil, in the absence of solvent, is chilled to crystallize out the wax particles which are then pressed out by a filter. In general, only light hydrocarbon oil fractions (paraffinic fractions) obtained by vacuum distillation are treated by press dewaxing processes due to viscosity limitations. More widely used are solvent dewaxing processes wherein a waxy oil is mixed with a solvent and then chilled to precipitate the wax as tiny particles or crystals thereby forming a slurry comprising solid wax particles and a solution of dewaxed oil containing dewaxing solvent. The slurry is then fed to a wax filter wherein the wax is removed from the dewaxed oil and dewaxing solvent. Solvent dewaxing processes are used for heavier oil fractions such as lubricating oil fractions and bright stocks. Typical dewaxing solvents include low boiling point, normally gaseous autorefrigerative hydrocarbons such as propane, propylene, butane, pentant, etc., ketones such as acetone and MEK, MIBK, and mixtures thereof, aromatic hydrocarbons such as benzene, toluene and xylene as well as mixtures of ketones and aromatic hydrocarbons such as MEK/toluene and acetone/benzene and mixtures of ketones with autorefrigerants such as acetone/propylene.

One of the factors tending to limit the capacity of a solvent dewaxing plant is the rate of wax filtration from the dewaxed oil, which in turn is strongly influenced by the crystal structure of the precipitated wax. Although the crystal structure of the precipitated wax is influenced by various operating conditions in the dewaxing process, for any given feed, it is most strongly influenced by the chilling conditions. The size and crystal structure of the precipitated wax, occlusion of oil in the wax crystal and the condition of the oil left in the crystal are extremely varied and depend on the wax composition and precipitation conditions. These conditions also effect the filtration rate of the dewaxed oil from the wax and the yield of dewaxed oil. In some cases, most notably when the waxy oil is a bright stock, the wax crystals are of an extremely fine size and not all are separated by filtration, but some leave the filter with the dewaxed oil component which creates an objectionable haze in the oil.

One way of increasing the filtration rate and minimizing haze formation is to add a dewaxing aid to the wax-containing oil. Well-known in the art are dewaxing aids such as α-olefin copolymers, mixtures of materials such as a mixture of (a) an ethylene-vinyl acetate copolymer and (b) an unsaturated ester of an aliphatic alcohol having from 2 to 20 carbon atoms with acrylic or methacrylic acid, as well as polymeric dewaxing aids comprising condensation products of chlorinated paraffins and naphthalenes alone or mixed with acrylic ester polymers. However, in the case of heavy stocks these dewaxing aids are not too efficient, thus requiring a relatively high concentration of the dewaxing aid in the oil. This is especially true when a heavy oil raffinate or a bright stock is solvent dewaxed. When these oils are solvent dewaxed, a portion of the wax is precipitated as crystals so fine that they pass through filter cloths, thereby creating a haze in the dewaxed oil which greatly reduces the commercial value of same. Also, because of the presence of so many fine particles of wax, the filter rate of the dewaxed oil tends to be lower than that obtained with lighter lube oil stocks.

Haze may also appear when the dewaxed oil is allowed to stand at room temperature for a long time. In order to prevent the occurrence of haze, it is sometimes necessary to filter the dewaxed oil through a filter of sintered metal or polyvinyl alcohol after the dewaxing step. However, these process steps are complicated and the dewaxing process becomes economically disadvantageous. Therefore, there is a need for efficient dewaxing aids, particularly for use with heavy stocks.

SUMMARY OF THE INVENTION

Accordingly, therefore, it has now been found that an improvement results in processes for solvent dewaxing wax-containing hydrocarbon oils employing dewaxing aids, if the dewaxing aid comprises a mixture of (a) lithium isostearate and (b) a polymer ester of at least one aliphatic alcohol with methacrylic acid or acrylic acid having a number average molecular weight ranging from between about 300,000 to 2,000,000. This combination dewaxing aid results in increased wax filtration rates compared to that obtained using the acrylic polymer alone.

Components (a) and (b) constituting the dewaxing aid of this invention will be used in a weight ratio to each other ranging from about 1/100 to 100/1 and preferably from b 1/10 to 10/1 of (a)/(b). This dewaxing aid is added to the waxy oil feed in an amount ranging from about 0.01 to 0.50 wt.% and preferably from about 0.10 to 0.20 wt.% of the oil. It has been found to be advantageous to prepare separate solutions of components (a) and (b) of the dewaxing aid by dissolving each component in a mineral oil or suitable solvent such as toluene, benzene, propane, methylene chloride and the like. The separate solutions of (a) and (b) can then be added to the wax-containing hydrocarbon oil or they can be combined and the combined solutions added to the wax-containing hydrocarbon oil.

The lithium isostearate used as component (a) in this invention was prepared by reacting equimolar quantities of lithium hydroxide and isostearic acid. Thus, a solution of 3 wt.% lithium hydroxide in water was mixed with a solution of 15 wt.% isostearic acid in ethanol, at room temperature and under agitation. A jelly-like precipitate of lithium isostearate was formed within a short time. The lithium isostearate precipitate was washed with water and dried in a laboratory oven at a temperature of about 105° C. The dry lithium isostearate was then dissolved in toluene by heating for from about 3 to 5 hours at a temperature of about 95° C. to form a 2–3 wt.% solution of lithium isostearate in toluene.

The polymer of the ester of an aliphatic alcohol with methacrylic or acrylic acid used as component (b) in the present invention is a polymer of an ester of at least one aliphatic alcohol having from about 6 to 30 carbon atoms and preferably from about 10 to 20 carbon atoms, with methacrylic or acrylic acid. It has been found that aliphatic alcohols having 5 or less carbon atoms or having 31 or more carbon atoms result in polymers which do not give the desired dewaxing effect. Illustrative but non-limiting aliphatic alcohol compositions suitable for use in the instant invention include a mixture of (a) 0 to 30 wt.% of an alcohol having 10 carbon atoms, (b) about 10 to 40 wt.% of an alcohol having 12 carbon atoms, (c) about 10 to 40 wt.% of an alcohol having 14 carbon atoms, (d) about 10 to 40 wt.% of an alcohol having 16 carbon atoms, (e) about 10 to 40 wt.% of an alcohol having 18 carbon atoms, and (f) about 0 to 30 wt.% of an alcohol having 20 carbon atoms.

As hereinbefore stated, supra, the ester polymer (b) will have a number average molecular weight ranging from about 300,000 to 2,000,000 and preferably from about 400,000 to 1,500,000. It has been found that known copolymers of aliphatic alcohols with methacrylic or acrylic acid having an average molecular weight of less than about 300,000 or more than about 2,000,000 do not prevent haze formation and do not yield increases in the amount of dewaxed oil or dewaxing rate. Further, those having molecular weights less than about 5,000 have no effect as dewaxing aids while those having molecular weights exceeding 3,000,000 inhibit the dewaxing effect due to poor solvent solubility. One commercially available acrylic ester polymer that has been found to be useful as component (b) of this invention is Acryloid-150 available from the Rohm and Haas Company.

The dewaxing solvent that is used in the present invention is not particularly critical, provided that the dewaxing aid stays in solution. Thus any of the well-known dewaxing solvents can be used. For example, there may be used at least one member selected from linear hydrocarbons having 2 to 10 carbon atoms in the molecule, such as ethane, propane, butane, pentane, hexane, octane, ethylene, propylene, butylene, pentene, hexene and octene, or a mixture of at least one member selected from ketones having from 3 to 6 carbon atoms, such as acetone, dimethyl ketone, methylethyl ketone, methylpropyl ketone and methylisobutyl ketone with at least one member selected from an aromatic hydrocarbon such as benzene, xylene or toluene, such as methylethyl ketone/toluene or methylisobutyl ketone/toluene. Also useful are halogenated hydrocarbons such as methylene chloride. Further, N-alkylpyrrolidones may be used as the dewaxing solvent. Still further, mixtures of autorefrigerative solvents and ketones can be used as the dewaxing solvent, such as a mixture of acetone and propylene. Solvents which have been found to be especially preferred for practicing the process of the present invention include propane, other autorefrigerative solvents, toluene, mixtures of a ketone and an aromatic hydrocarbon such as MEK/toluene, methylene chloride and mixtures of acetone and methylene chloride.

Any waxy petroleum oil stock or distillate fraction thereof may be dewaxed employing the dewaxing aid of this invention, although heavy feedstocks are preferred. Illustrative but non-limiting examples of such stocks are (a) distillate fractions that have a boiling range within the broad range of from about 250° to 700° C., with preferred stocks including lubricating oil and specialty oil fractions boiling within the range of from between about 300° and 650° C. and (b) bright stocks and deasphalted resids having an initial boiling point above about 425° C. Additionally, any of these feeds may be hydrocracked prior to distilling or deasphalting. These may come from any source such as paraffinic crudes obtained from Aramco, Kuwait, the Panhandle, North Louisiana, etc., naphthenic crudes, such as Tia Juana, Coastal crudes, etc., as well as the relatively heavy feedstocks such as bright stocks having a boiling range of 565+° C. and synthetic feedstocks derived from Athabasca tar sands, Cold Lake crude, coal, etc.

DESCRIPTION OF THE PREFERRED EMBODIMENT

In a preferred embodiment of the process of this invention, a solution of dewaxing aid comprising components (a) and (b) dissolved in an appropriate solvent such as a light heating oil or a light mineral oil fraction is mixed into the wax-containing oil and the mixture heated to a temperature higher than the cloud point of the oil (about 50° to 120° C.). This mixture is introduced, along with the dewaxing solvent, into a chilling zone and chilled to a temperature necessary to yield the desired pour point for the resulting dewaxed oil. The chilling produces a slurry comprising dewaxed oil and solvent along with solid particles of wax which contain the dewaxing aid. This slurry is then sent to a wax filter to separate the dewaxed oil and solvent from the wax particles. The dewaxing temperature or temperature to which the slurry is chilled varies depending on the feed and conditions. In general, this temperature will range from about 0° to about −50° C. In the case where the dewaxing solvent comprises a mixture of a ketone and an aromatic hydrocarbon, such as methylethyl ketone/toluene, the dewaxing temperature will range from about −10° to about −30° C. Where propane is used as the dewaxing solvent, the dewaxing temperature will generally be from about −20° to about −40° C. Preferred dewaxing solvents used in the process of this invention include propane, other autorefrigerative solvents, a mixture of a ketone and an aromatic hydrocarbon as well as a mixture of a ketone and methylene chloride. The ratio of solvent to waxy oil would generally range from about 0.5 to 10 and preferably from about 2 to 7, by volume. The optimum amount of dewaxing solvent employed is of course determined by the wax content of the oil, viscosity, pretreatment and dewaxing conditions.

The invention will be more apparent from the Example set forth below.

EXAMPLE

A bright stock having a viscosity of 2500 SUS at 100° F. obtained from a light Arabian crude oil was charged into an autoclave, along with dewaxing aid. Propane was then added in the amounts shown in Table 1. The dewaxing aid was added to the bright stock as a 3 wt.% solution in a light heating oil. The mixture of bright stock, dewaxing aid and propane was heated in the autoclave to 60° C. to form a homogeneous solution and then prechilled to 16° C. via indirect, external heat exchange under agitation, at a chilling rate of 6° C. per minute. The propane solvent was then allowed to evaporate which chilled the mixture to −34° C. at a chilling rate of 2.8° C./min. to form a slurry of dewaxed oil, solvent and solid particles of wax. After the chilling operation, the slurry was fed to a wax filter where filtration was conducted at a temperature of −34.4° C. and at a filtration pressure differential of 34 KPA and the filtration rate was determined. The results are shown in Table 1.

TABLE 1

PROPANE DEWAXING OF ARABIAN LT. 2500 BRIGHT STOCK WITH LITHIUM ISOSTEARATE/ METHACRYLATE ESTER DEWAXING AID

| Run No. | 2 | 3 |
|---|---|---|
| Dewaxing Aid | Acryloid-150 | Lithium isostearate/ Acryloid-150 |
| amount, wt. % on feed | 0.10 | 0.01/0.10 |
| Propane dilution, vol. on feed | 3.14 | 2.70 |
| Feed Filtration Rate, $m^3/m^2$ day | 4.6 | 6.0 |
| Wax Cake liquids/solids ratio, weight basis | 2.4 | 2.8 |

Thus, the data show that the feed filter rate for the oil containing the Acryloid-150 alone but no lithium isostearate was 4.6, whereas when 100 wt. ppm (on waxy oil feed) of lithium isostearate was present in the dewaxing aid, the feed filter rate was 6.0, thus yielding a 30% improvement in feed filter rate.

What is claimed is:

1. A solvent dewaxing process comprising mixing a waxy hydrocarbon oil with dewaxing solvent and a dewaxing aid comprising a mixture of (a) lithium isostearate and (b) an acrylic ester polymer, which polymer has a number average molecular weight ranging from about 300,000 to 2,000,000 and which polymer is an ester of at least one aliphatic $C_6$–$C_{30}$ alcohol, and chilling said oil, dewaxing solvent, and dewaxing aid mixture to form a slurry comprising solid particles of wax and a solution of dewaxed oil and dewaxing solvent and separating said wax from said dewaxed oil solution.

2. The process of claim 1 wherein said polymer is an ester of at least one aliphatic alcohol with methacrylic acid or acrylic acid.

3. The process of claim 2 wherein said dewaxing aid is used in an amount ranging from about 0.01 to 0.50 wt.% of the waxy oil.

4. The process of claim 3 wherein components (a) and (b) constituting the dewaxing aid are used in a weight ratio to each other ranging from about 1/100 to 100/1 of (a)/(b).

5. The process of claim 4 wherein said dewaxing solvent comprises a member selected from the group consisting of (a) one or more autorefrigerative solvents, (b) mixtures of one or more aromatic hydrocarbons with at least one ketone having from 3 to 6 carbon atoms, (c) methylene chloride, and (d) a mixture of acetone and methylene chloride.

6. The process of claim 5 wherein said oil is a natural or synthetic lube oil fraction.

7. A solvent dewaxing process comprising chilling a mixture of a waxy petroleum oil fraction, a dewaxing solvent and a dewaxing aid used in an amount ranging from about 0.01 to 0.50 wt.% of said oil and comprising a mixture of (a) lithium isostearate and (b) an acrylic ester polymer having a number average molecular weight ranging from about 300,000 to 2,000,000, and which polymer is an ester of at least one aliphatic $C_6$–$C_{30}$ alcohol, to form a slurry comprising solid particles of wax and a solution of dewaxed oil and solvent and separating said wax from said slurry.

8. The process of claim 7 wherein components (a) and (b) are used in a weight ratio to each other ranging from 1/100 to 100/1 of (a)/(b) and wherein (b) is an ester of at least one aliphatic alcohol with methacrylic acid or acrylic acid.

9. The process of claim 8 wherein said dewaxing solvent comprises a member selected from the group consisting of (a) one or more autorefrigerative solvents, (b) mixtures of one or more aromatic hydrocarbons with at least one ketone having from 3 to 6 carbon atoms, (c) methylene chloride, and (d) a mixture of acetone and methylene chloride.

10. A process for solvent dewaxing a bright stock comprising mixing said bright stock with a dewaxing aid in an amount ranging from 0.01 to 0.50 wt.% of said bright stock and with dewaxing solvent to form a mixture and chilling said mixture to form a slurry comprising solid particles of wax and a solution of dewaxed oil and solvent and separating said wax from said slurry and wherein said dewaxing aid comprises a mixture of (a) lithium isostearate and (b) an acrylic ester polymer having a number average molecular weight ranging from about 300,000 to 2,000,000 and which polymer is an ester of at least one aliphatic $C_6$–$C_{30}$ alcohol.

11. The process of claim 10 wherein components (a) and (b) are used in a weight ratio to each other ranging from 1/100 to 100/1 of (a)/(b) and wherein (b) is an ester of at least one aliphatic alcohol with methacrylic acid or acrylic acid.

12. The process of claim 11 wherein said dewaxing solvent comprises a member selected from the group consisting of (a) one or more autorefrigerative solvents, (b) mixtures of one or more aromatic hydrocarbons with at least one ketone having from 3 to 6 carbon atoms, (c) methylene chloride, and (d) a mixture of acetone and methylene chloride.

* * * * *